US011773588B2

(12) United States Patent
Rogers

(10) Patent No.: US 11,773,588 B2
(45) Date of Patent: Oct. 3, 2023

(54) TOGGLE INSERT FOR RECEIVING A TOGGLE ASSEMBLY IN A STEEL CURTAIN WALL STRUCTURE

(71) Applicant: SAINT-GOBAIN GLASS FRANCE, Courbevoie (FR)

(72) Inventor: Brendan Rogers, Issaquah, WA (US)

(73) Assignee: SAINT-GOBAIN GLASS FRANCE, Courbevoie (FR)

( * ) Notice: Subject to any disclaimer, the term of this patent is extended or adjusted under 35 U.S.C. 154(b) by 18 days.

(21) Appl. No.: 17/517,196

(22) Filed: Nov. 2, 2021

(65) Prior Publication Data

US 2022/0154460 A1 May 19, 2022

(30) Foreign Application Priority Data

Nov. 17, 2020 (IN) ..... 202041049998

(51) Int. Cl.
*E04B 2/96* (2006.01)
*E06B 3/54* (2006.01)

(52) U.S. Cl.
CPC ..... *E04B 2/965* (2013.01); *E06B 3/5481* (2013.01)

(58) Field of Classification Search
USPC ..... 411/84, 85, 437
See application file for complete search history.

(56) References Cited

U.S. PATENT DOCUMENTS 2,442,147 A * 5/1948 Recklitis ..... E05D 13/08 49/418
5,078,537 A * 1/1992 Nomura ..... F16B 37/046 411/84
5,636,954 A * 6/1997 Henderson ..... B60R 9/04 411/84
5,833,417 A * 11/1998 Sargent ..... F16B 37/046 411/432

(Continued)

FOREIGN PATENT DOCUMENTS

CN 111197369 A 5/2020
CN 111411719 A 7/2020

(Continued)

OTHER PUBLICATIONS

Extended European Search Report as issued in European Patent Application No. 21208802.5, dated Apr. 19, 2022.

*Primary Examiner* — Joshua K Ihezie
(74) *Attorney, Agent, or Firm* — Pillsbury Winthrop Shaw Pittman LLP

(57) ABSTRACT

A toggle insert for receiving a toggle assembly in a steel curtain wall structure is disclosed. The toggle insert is a self-leveling profile requiring no welding for fastening to steel curtain wall structure and further provides a screw tolerance of up to 1 inch for locating and fastening toggle screws during installation of glazing elements to the steel curtain wall structure. The toggle insert includes a horizontal section having a front portion, an intermediate portion and a bottom portion, wherein the front portion includes a central elongated opening measuring between 21 mm and 25 mm (Continued)

sandwiched on either sides by slotted screw race and a pair of threaded set screws for leveling into the slotted screw race that fixes the toggle insert by way of wedging into the steel curtain wall structure.

11 Claims, 5 Drawing Sheets

(56) References Cited

U.S. PATENT DOCUMENTS

| | | | | |
|---|---|---|---|---|
| 6,401,410 | B2 * | 6/2002 | Kenny | E06B 3/5427 52/235 |
| 6,672,018 | B2 * | 1/2004 | Shingleton | F24S 25/636 126/621 |
| 6,994,499 | B2 * | 2/2006 | Hoffmann | F16B 37/045 411/84 |
| 7,950,531 | B2 * | 5/2011 | Morris | H04Q 1/142 411/21 |
| 9,598,893 | B2 * | 3/2017 | Vandervelden | E06B 1/36 |
| 10,202,797 | B1 * | 2/2019 | Header | E06B 3/26303 |
| 2002/0071735 | A1 * | 6/2002 | Dinh | F16B 37/046 411/85 |
| 2006/0070318 | A1 * | 4/2006 | Chen | E06B 3/5454 52/204.5 |

FOREIGN PATENT DOCUMENTS

| | | | |
|---|---|---|---|
| DE | 20 2013 100925 | U1 | 6/2014 |
| IT | GO 20 090 009 | A1 | 5/2011 |

* cited by examiner

TOGGLE INSERT FOR RECEIVING A TOGGLE ASSEMBLY IN A STEEL CURTAIN WALL STRUCTURE

CROSS-REFERENCE TO RELATED APPLICATIONS

This application claims priority to Indian Patent Application No. 202041049998, filed Nov. 17, 2020, the entire content of which is incorporated herein by reference in its entirety.

FIELD

The present invention relates, in general to a steel curtain wall structure in a building façade comprising a plurality of glazing elements covering at least a portion of the building. Particularly, the invention relates to a toggle assembly for holding the glazing elements to the steel curtain wall structure. More particularly, the invention relates to a toggle insert for receiving the toggle assembly during installation of glazing elements in a steel curtain wall structure.

BACKGROUND

Glass curtain walls are generally being used increasingly as facades both in new construction and in the renovation of older buildings. Primarily office buildings are being increasingly constructed with glass curtain walls. The glass curtain wall may form the stressed-skin of the building façade directly. Then the glass curtain wall forms the building's outer wall, which is usually built into a latticed frame through an inner frame profile and an outer frame profile, with glass embedded in the latticed frame.

To obtain, on such glass facades a fixing as discreet as possible and above all invisible from the outside, it is known to provide rails for fixing the joints of the peripheral edges so that the glazing insulators can be supported by anchors or fixing hooks which enter the fixing rails by retaining pins arranged on the outer face. In the prior art, the connection structure (i.e., the toggle insert) between the frame profile (including a gasket race) and the glass has the following process steps:

Firstly, the toggle insert is a weld-in insert that needs to be welded in place into the gasket race of the frame profile. This process needs to be done with precision as the insert needs to be level and plumb with the profile, or else the toggle screw is set at an angle resulting in uneven pressure on the glass. Further unstable welding quality results in the problem of collapse when the load bearing is large;

Secondly, since the toggle insert is placed behind or below the EPDM gasket, the toggle screw will need to be located perfectly to screw through the EPDM gasket and into the threaded hole of the welded insert. The threaded hole of the insert is often very difficult for the installer to locate trough the EPDM gasket which overlies it.

Above mentioned steps of the prior art are labor intensive, inflexible in installation and the glass curtain wall cannot be changed subsequently after the primary design and processing of the glass curtain wall are finished. Inventions that describe connecting structures that are simple to operate and need not be welded to the frame profile have already been described in the patent literature.

The utility model CN111411719 relates to a connecting piece having a T-shaped bolt and a fastening piece. The connecting piece matches and clamps the mounting groove of the inner frame strip by the flat head of the T-shaped bolt and the outer frame strip is fixed on the inner frame strip in a butt joint manner by locking the connecting piece and the fastening piece. The utility model CN111197369 describes a stud as the connecting piece and a fastening nut. The mounting groove of the inner frame strip matches the stud and the fastening nut such that inner and outer frame strip are butted and fastened without requiring a welding action.

While these inventions offer toggle screw tolerance of being able to locate and fasten anywhere in the gasket race of the profile, the associated drawback is that the installer will have to use a "Very high Bond" (VHB) tape in lieu of the regular gasket to install the threaded post after the glass is installed or place the threaded steel posts prior to the glass installation itself. This however, results in a very delicate glass installation with a high risk of potential glass damage.

Thus in order to overcome the defects of the prior art, the present invention intends to steer clear of the welding action of the toggle inserts due to the complexity involved and further to increase the screw tolerance for the installers to locate and fasten the toggle screw into the toggle insert through the EPDM gasket. Both the above actions without compensating the stability of the curtain wall system.

SUMMARY

Thus, an aspect of the present invention proposes a toggle insert for receiving a toggle assembly in a steel curtain wall structure comprising:

- a horizontal section having a front portion, an intermediate portion and a bottom portion, characterized in that the front portion comprises a central elongated opening measuring between 21 mm and 25 mm sandwiched on either sides by slotted screw race; and
- a pair of threaded set screws for anchoring into the slotted screw race that fixes the toggle insert by way of wedging into the steel curtain wall structure,
- wherein the intermediate portion of the horizontal section is oblong having an internal angle ranging between 34 and 38 degrees.

The toggle insert of the present invention is designed to be simply dropped into the gasket race of steel support beams of a curtain wall substructure, rotated and screwed using the threaded set screws forcing the toggle insert into the neck of the gasket race thus eliminating any welding action for fixing the toggle insert to the steel support beams. The central elongated opening in the horizontal section of the toggle insert provides a screw tolerance of up to 1 inch for receiving a screw holding glazing elements to the steel support beams. Thus the installation of a curtain wall structure using the toggle insert of the present invention involves less labor, time and skill when compared to the conventional manner of installation.

An aspect of the invention further proposes a curtain wall installation kit comprising steel support beams, glazing elements, toggle assemblies, toggle inserts, gasket and a thermal acoustic material. The invention furthermore proposes a method for assembling a curtain wall in a façade structure using the toggle insert described hereinafter.

An objective of the present invention is therefore to replace the current weld-in inserts commercially used in steel curtain wall systems with the proposed toggle insert of the present invention. The purpose of the toggle insert of the present invention is to provide an insert similar to the type used currently that accepts a toggle screw but with the following improvements:

(i) Utilizing the gasket race of the steel support beams (of the steel curtain wall systems) for retaining the toggle insert in place of welding the insert;

(ii) Self-leveling profile of the toggle insert that utilizes the tapered walls of the gasket race of the steel support beams to ensure proper alignment of toggle insert;

(iii) a pair of threaded set screws to eliminate the need of welding the insert into the gasket race of the steel support beams, as the set screws force the toggle insert into the neck of the gasket race; and (iv) elongated central opening in the toggle insert for easing installation of toggle screw through the gasket and into the toggle insert allowing a screw tolerance of up to 1 inch.

Steel curtain wall systems comprise of steel support beams which are steel material having a predetermined cross-sectional shape by being processed to be bent and having generally an integrally bent concave groove portion (herein referred to as gasket race) in one side. The gasket race is formed longitudinally in the center at the front side of the steel support beam. The cross-section of the gasket race generally vanes from circular to square to rectangular shapes. Since the proposed toggle insert of the present invention makes use of the gasket race in order to be secured to the steel support beams, it would be beneficial to have a toggle insert that is compatible with any steel curtain wall systems having any of the above mentioned gasket race shape. Thus the cross section of the toggle insert proposed by the present invention is adapted to be compatible with the cross section of the gasket race of the steel support beams.

The toggle insert of an aspect of the present invention is a steel bar profile that will be cast in a manner similar to a toggle itself. Installing the toggle insert would be as simple as dropping the toggle insert down the neck of the gasket race, rotating it 90 degrees, leveling the threaded set screws at each end. The threaded set screws lift the toggle insert upward forcing it to nested within the neck and self-level itself into the steel support beam.

According to the invention, the toggle insert for receiving a toggle assembly in a steel curtain wall structure comprises a horizontal section having a front portion, an intermediate portion and a bottom portion, characterized in that the front portion comprises a central elongated opening measuring between 21 mm and 25 mm sandwiched on either sides by slotted screw race; and a pair of threaded set screws that fixes the toggle insert by way of wedging into the steel support beams. The intermediate portion of the horizontal section is oblong having an internal angle ranging between 34 and 38 degrees.

The internal angle between 34 and 38 degrees is the optimized angle that makes the toggle insert of the present invention a self-leveling profile requiring no welding activity for fixing into steel support beams having a gasket race including a narrow opening and a wider inner surface flanked on either sides by support plates. The internal angle of the toggle insert varies according to the cross section of the gasket race of the steel support beams.

Once the toggle insert is wedged into the neck of the gasket race, the central elongated opening in the toggle insert provides a screw tolerance of up to 1 inch for locating and fastening toggle screws during installation of glazing elements to the steel support beams. The glazing elements are abutted on either sides of the gasket race of the steel support beams during installation and are held in place to the steel support beams using toggle assemblies, where the toggle screws hold the glazing element to the steel support beams by screwing through the toggle inserts.

In an embodiment, the toggle inserts are arranged such that they are positioned at 150-200 millimeters from the edges of each of the glazing elements that are to be secured to the steel support beams and are spaced centrally at intervals of 300-400 millimeters between them. The positions of the toggle inserts are nevertheless determined by the dimension of the glazing elements that are to be installed on the steel curtain wall structure. The number and position of toggle inserts further vary depending on wind load, structural load of the glazing elements among other factors.

Another objective of the present invention is a curtain wall installation kit that comprises steel support beams for mounting on the outer surface of a building to form a curtain wall substructure; glazing elements having at least two parallel glazing bonded to one another and spaced apart by a spacer frame, the space external to said spacer frame between the two glazing filled with a sealing material; toggle assemblies having a toggle, a plastic sleeve and a screw for securing the glazing elements to the steel support beams; toggle inserts for receiving the toggle assemblies; gasket for overlaying the curtain wall substructure and a thermal acoustic material for application between adjacent glazing elements anchored to the steel support beams.

The glazing elements comprise U-shaped channel inserts set within the sealing material bonding the two glazings that are used by the toggle assemblies during installation for securing the glazing elements to the steel support beams.

Another objective of the present invention is a method for assembling a curtain wall in a façade structure involving no welding action during insertion of toggle insert to the steel support beams, the method comprising mounting steel support beams on the outer surface of a building to form a curtain wall substructure; securing toggle inserts within the gasket race of the steel support beams; pressing the gasket into the neck of the gasket race; and securing the glazing elements on the curtain wall substructure using toggle assemblies; turning the toggle of the toggle assembly such that the toggle is placed within the U-shaped channel insert set in the glazing element thereby anchoring the glazing element to the steel support beams and applying the thermal acoustic material in the space between adjacent glazing elements to conceal underlying fixing components.

Other features and aspects of this disclosure will be apparent from the following description and the accompanying drawings. The figures and the description of the invention which follow will make it possible to understand what was the technical problem to be solved and how it has arrived at in the solution according to the invention is to provide.

BRIEF DESCRIPTION OF THE DRAWINGS

Embodiments are illustrated by way of example and are not limited to those shown in the accompanying figures.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiments of the invention.

DETAILED DESCRIPTION

Wherever possible, the same reference numbers will be used throughout the drawings to refer to the same or similar parts. Embodiments disclosed herein are related to toggle insert for receiving a toggle assembly during installation of glazing elements in a steel curtain wall structure. Further the invention relates to a curtain wall installation kit and a method for assembling a curtain wall in a façade structure thereon.

Figure 1:
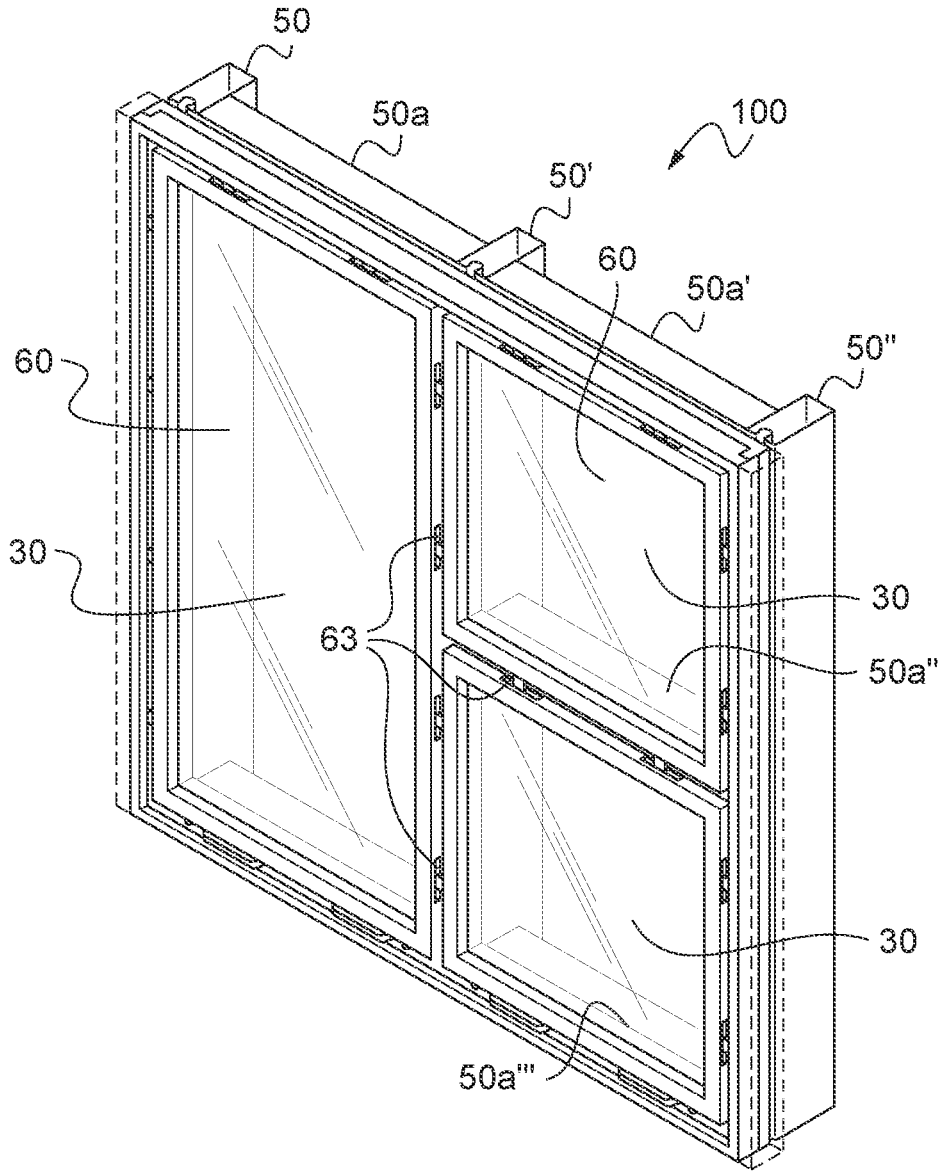
FIG. 1 illustrates a front view of a steel curtain wall system, according to an embodiment of the present invention.

FIG. 1 illustrates a front view of a steel curtain wall system 100 according to some embodiments of the present invention. The system 100 is shown in partial (building structure is not shown) to comprise of vertical steel support beams 50, 50', 50" and horizontal steel support beams 50*a*, 50*a'*, 50*a"*, 50*a'"*. The vertical steel support beams 50, 50', 50" are generally positioned in parallel and the horizontal steel support beams 50*a*, 50*a'*, 50*a"*, 50*a'"* are generally positioned perpendicularly at the ends of the vertical steel support beams 50, 50', 50". Depending on the dimensions of glazing elements, the horizontal steel support beams are positioned centrally or otherwise along the length of the vertical steel support beams as shown in FIG. 1. Although not shown it is understood that the vertical and horizontal steel support beams 50 are mechanically fastened on a building structure using fastening means to be held securely and bear loads whilst being held securely in position on the building structure. The mechanical fastening means may comprise of screws, bolts or rivets etc.

The vertical and horizontal steel support beams 50 once secured on the building structure generally form a beam cavity 30. It may be appreciated that glazing element such as windows, glass, panels or plates or other objects may be inserted within the beam cavity 30 to cover or span the space, light or opening created by the vertical and horizontal steel support beams 50. In the embodiment shown in FIG. 1, the beam cavity 30 is covered with glazing elements 60 comprising at least two parallel glazing bonded to one another and spaced apart by a spacer frame 61, according to one embodiment of the present invention. The space external to the spacer frame 61 between the two glazing is filled with a sealing material, according to another embodiment of the present invention. The glazing elements 60 are mounted on to the vertical and horizontal steel support beams 50 such that the front face of the glazing elements 60 form the exterior component of the building structure. In another embodiment of the present invention, the glazing element 60 is a fire-rated/fire-resistant glazing that protects the building from hot gases, smoke and heat transmission.

Figure 2:
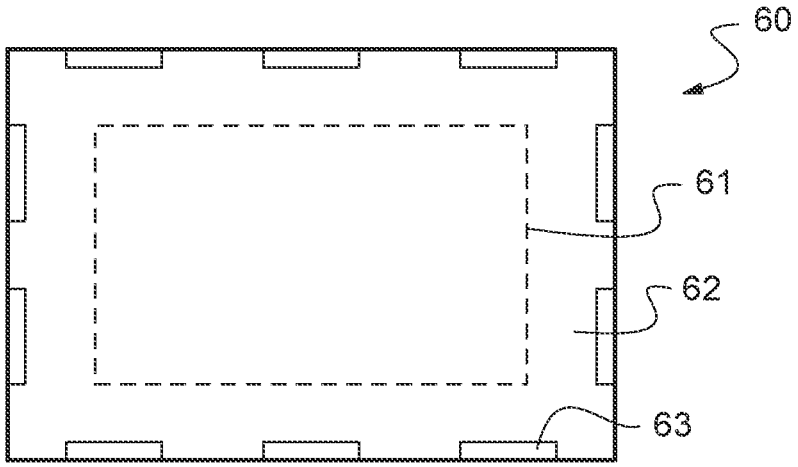
FIG. 2 illustrates a front view of a glazing element, according to an exemplary embodiment of the present invention.

The glazing elements 60 further comprise U-shaped channel inserts 63 set within the sealing material between the two glazing, according to yet another embodiment of the present invention. The U-shaped channel inserts 63 are spaced apart from the one another and have projecting structures that engage with the toggle assembly during installation. The U-shaped channel inserts 63 are separated from the spacer frame 61, thanks to the sealing material that fill the exterior space between the two glazing owing to which the U-shaped channel inserts 63 are not in contact with the spacer frame 61. FIG. 2 shows the front view of a glazing element 60 according to an exemplary embodiment of the present invention where two glazing are held together by a spacer frame 61, leaving a free hollow interior space 62 that is set with U-shaped channel inserts 63 in different positions. The positions depicted in FIG. 2 are for teaching purposes and do not in any manner limit the scope of the present invention. The position at which the U-shaped channel inserts 63 are set generally vary depending on the type & dimension of the glazing element 60 but could further vary depending on the installation site, associated wind load, load bearing requirements of the curtain wall structure among other factors.

In all embodiments of the present invention, the steel support beams 50 are made by bending steel sheets. Variously dimensioned steel support beams 50 can be manufactured using bending techniques. In a bending technique different tooling would be used to manufacture steel support beams 50 having different dimensions. Length of the steel support beams 50 vary depending on the desired curtain wall design applications. Likewise, the steel support beams 50 are also manufactured in varying widths. Thus different lengths, widths and depths and other dimensions may also be varied as desired.

In an example embodiment, the steel support beams 50 can have a length of at least up to 24 feet. Therefore, a bending tool which is at least 24 feet long is used to form the steel support beams 50 at such length. Steel support beams 50 may also be of smaller lengths as desired and smaller tooling may also be used. In an example embodiment, the steel support beams 50 may vary in width from 1¾ inches (45 mm), for instance, to 4 inches (100 mm) or more and may vary in depth from 4 inches (100 mm), for instance, up to 16 inches (405 mm) or more.

Figure 3:
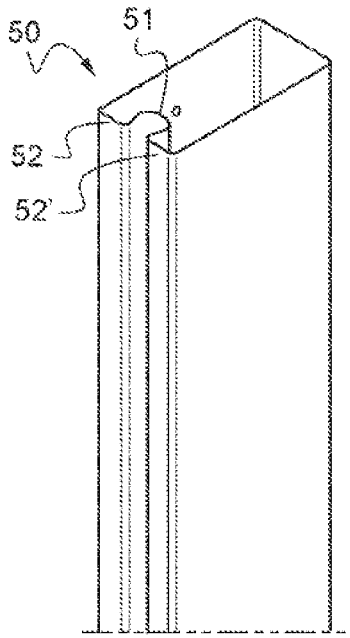
FIG. 3 illustrates an isometric view of steel support beam that from the curtain wall substructure on a building facade, according to an embodiment of the present invention.

FIG. 3 illustrates one such steel support beam 50, according to an exemplary embodiment of the present invention. Steel support beams 50 generally have a box-shaped cross section having a longitudinal groove 51 (herein referred to as gasket race 51) extending over the entire length of the steel support beam 50. The steel support beams 50) are steel bar profiles with the gasket race 51 forming a narrow opening and a wide inner surface in the front side of the steel support beam 50. The gasket race 51 is flanked on either sides by support plates 52, 52' that support adjacent glazing elements 60 when positioned on either sides of the gasket race 51.

According to multiple embodiments of the present invention, the gasket race 51 can be circular, square or a rectangular shape in cross-section, again depending on the desired application. In the specific embodiment illustrated in FIG. 3, the gasket race 51 is shown to have a circular cross-section. The toggle insert 1 proposed by the present invention makes use of the gasket race 51 present in the steel support beams 50 for fixing into the steel support structure in place of welding and thus replaces the welding action associated with conventional installation process. Since the toggle insert 1 utilizing the gasket race 51 for fixing, it is significant for the toggle insert 1 to be designed in such a manner as to be compatible with any given shape of the gasket race 51.

Figure 4:
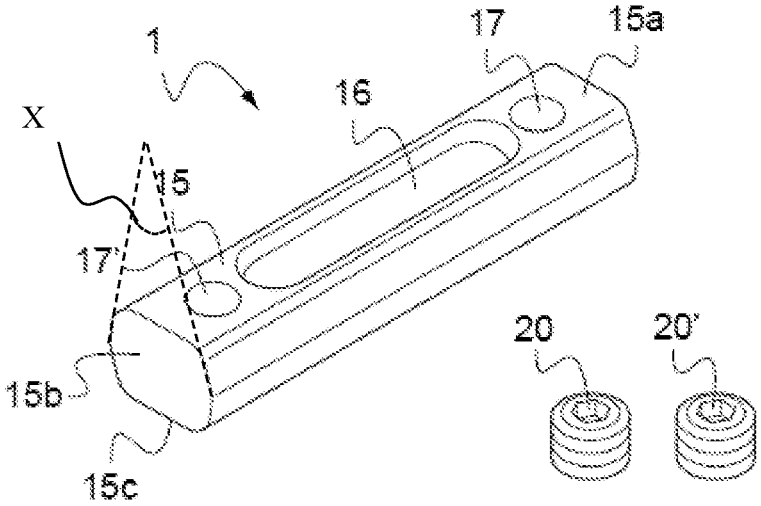
FIG. 4 illustrates an isometric view of the toggle insert, according to an embodiment of the present invention.

The toggle insert 1 proposed by the present invention is shown in FIG. 4, according to an embodiment of the present invention. The toggle insert 1 comprises of a horizontal section 15 and a pair of threaded set screws 20, 20'. The horizontal section 15 comprises of a front portion 15*a*, an intermediate portion 15*b* and a bottom portion 15*c*, characterized in that the front portion 15*a* comprises a central elongated opening 16 measuring between 21 mm and 25 mm sandwiched on either sides by slotted screw race 17, 17'. According to a particular embodiment of the present, the central elongated opening 16 measure 23 mm. The horizontal section 15 is a steel bar profile produced by steel casting. The pair of threaded set screws 20, 20' are screwed into the slotted screw race 17, 17' that fixes the toggle insert 1 by way of wedging into the steel curtain wall structure i.e., the steel support beam 50.

Figure 3A:
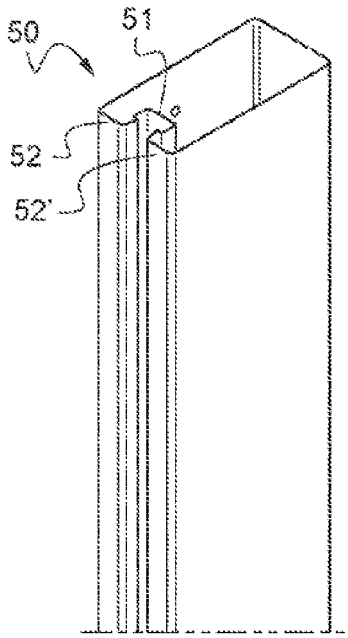
FIG. 3A illustrates an isometric view of steel support beam that from the curtain wall substructure on a building facade, according to another embodiment of the present invention.

The shape of the horizontal section 15 of the toggle insert 1 is adapted to the shape of the gasket race 51 present in the steel support beam 50. According to an embodiment of the present invention, intermediate portion 15*b* of the horizontal section 15 is oblong having an internal angle X ranging between 34 and 38 degrees. Such an internal angle X makes the toggle insert 1 to be compatible with gasket race having a circular (as shown in FIG. 3) or square (not shown) or rectangular (shown in an example embodiment illustrated in FIG. 3A) shape. In all the above mentioned variants, the gasket race has a narrow opening and a wider inner surface flanked on either sides by support plates as described in the earlier section. In a specific exemplary embodiment of the present invention, the horizontal section 15 has an internal angle X measuring 36 degrees as shown in FIG. 4.

Figure 5:
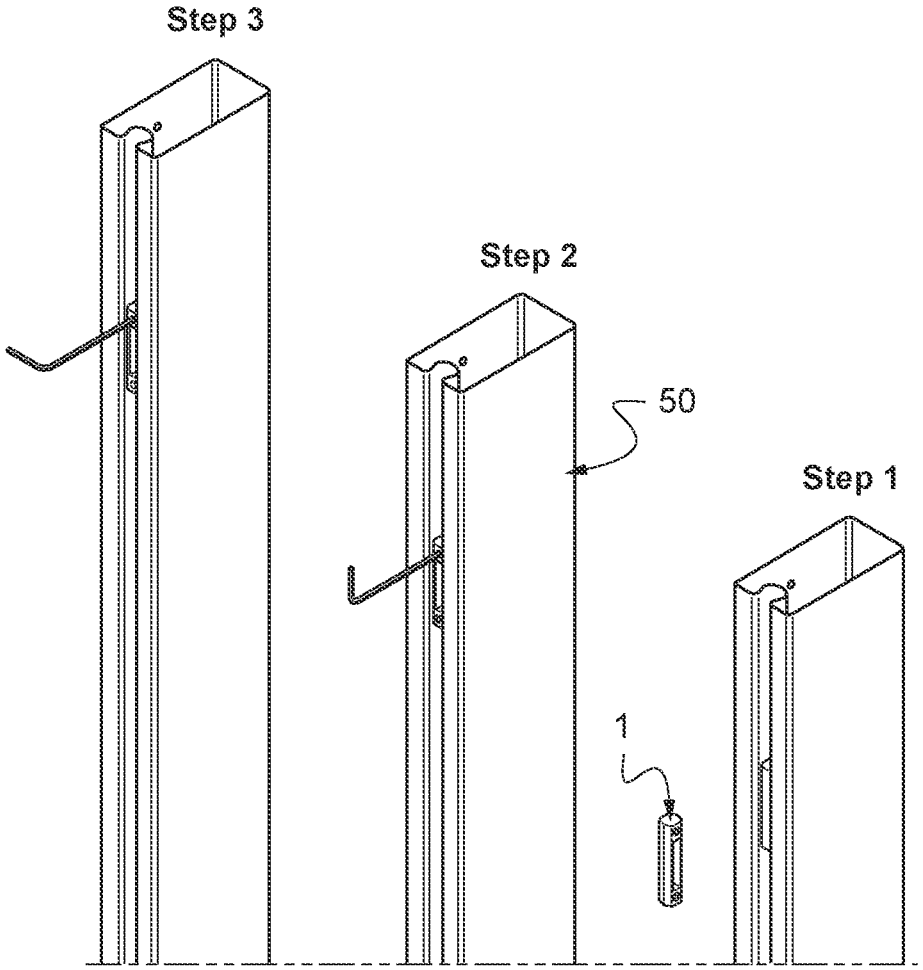
FIG. 5 demonstrates steps involved in securing a toggle insert within a steel support beam of the curtain wall substructure, according to an embodiment of the present invention.

The steps involved in fixing the toggle insert 1 by way of wedging into the steel support beam 50 is illustrated in FIG. 5. In step 1 the toggle insert 1 is dropped into the gasket race 51 of the steel support beam 50 such that the intermediate portion 15*b* of the toggle insert 1 abuts the neck of the gasket race 51 as shown in the illustration. The toggle insert 1 fits in between the neck of the gasket race 51, thanks to the optimized compatible internal angle X of the horizontal section 15 of the toggle insert 1. In step 2, the toggle insert 1 nested in the neck of the gasket race 51 is rotated 90 degrees such that the slotted screw race 17, 17' are now visible through the neck of the gasket race 51. When rotated, the front portion 15*a* faces away from neck of the gasket race 51, thus exposing the slotted screw race 17, 17'.

In the final step 3, an Allen wrench is used to screw the pair of threaded set screws 20, 20' in the slotted screw race 17, 17' of the horizontal section 15*b*. This action tightens the set screws 20, 20' forcing the toggle insert 1 into the neck of the gasket race 51. In this manner the toggle insert 1 of the present invention is self-leveled into the steel support beam 50 eliminating any welding action which otherwise is associated with all known conventions installation systems for securing inserts into curtain wall structures.

Additional benefit of the toggle insert 1 of the present invention is the central elongated opening 16 in the front portion 15*a* of the horizontal section 15 of the toggle insert 1 measuring between 21 mm and 25 mm that provides a screw tolerance of up to 1 inch for locating and fastening screws during installation of glazing elements 60 to the steel curtain wall structure. Thus the toggle insert of the present invention enables simple, flexible, fast, stable curtail wall installations that are neither labor-intensive nor cumbersome.

Figure 6:
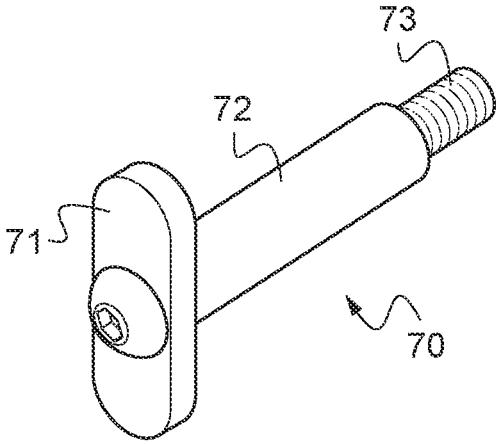
FIG. 6 illustrates an isometric view of a toggle assembly, according to an embodiment of the present invention.

One other component of the steel curtain wall system 100 of the present invention is the toggle assembly 70 illustrated in FIG. 6. The toggle assembly 70 consists of a toggle 71, a plastic sleeve 72 and a screw 73. During installation of the glazing elements 60 to the steel support beams 50, the screw 73 is fastened to the toggle insert 1 wedged to the steel support beams 50 and the toggle 71 is rotated 90 degrees for securing the glazing elements 60 on either of its sides. The toggle 71 when rotated 90 degrees locks itself within the U-shaped channel inserts 63 present in the glazing elements 60. Thus the toggle 71 abuts two adjacent glazing elements 60 on support plates 52, 52' of the steel support beams 50. The plastic sleeve 70 provided on the screw 73 protects the glazing elements 60 from scratches or any associated damages during the installation procedure by having a cushioning effect on the glazing elements 60.

Since the toggle assembly 70 is assembled post the step of pressing a gasket 80 over the steel support beams 50, the visibility of the toggle insert 1 for screwing the toggle screw 73 is significant in determining the installation time and ease of installation. Thanks to the screw tolerance of up to 1 inch provided by the toggle insert 1 of the present invention which enables an unchallenging installation procedure with easy means of locating the central elongated opening 16 in the front portion 15*a* of the horizontal section 15 of the toggle insert 1 for screwing of the screw 73.

According to another embodiment of the present invention, a curtain wall installation kit is provided which includes all the components described so far in the present invention viz., steel support beams 50 for forming a curtain wall substructure by mounting the steel support beams 50 to a structural substrate in the outer surface of a building. As described earlier said steel support beams 50 can have any described shape of the gasket race 51 and the scope of the present invention is not limited by the described shapes of the steel support beams 50 and the described shapes are merely for teaching purposes. The curtain wall substructure is generally constructed by joining a number of steel support beams 50 to form a beam cavity 30 with exposed gasket race 51 defined therein for retaining a gasket 80;

glazing elements 60 having at least two parallel glazing bonded to one another and spaced apart by a spacer frame, the space external to said spacer frame between the two glazing filled with a sealing material. The glazing elements 60 further comprises of U-shaped channel inserts set 63 within the sealing material bonding the two glazing. Said sealing material refers to any conventional sealing material used for the purposes of construction of glazing elements. According to one example embodiment of the present invention, the sealing material is silicone;

toggle assemblies 70;

toggle inserts 1;

gasket 80, are generally elastomeric gaskets that are retained within the gasket race 51 of steel support beams 50. The gasket 80 contains grooves running along the length thereof for insertion into the curtain wall structures. Ordinarily the gasket 80 includes a wedge shaped member insertable in the gasket race 51 in the steel support beams 50 whereby the gasket is crowded to cause the gasket race 51 to engage the glazing elements 60 more securely. A conventional gasket usually T-shaped in cross section can be used. The base of the T provides a tongue for insertion into a gasket race 51 in the steel support beams 50 supporting the gasket 80 and the glazing elements 60; and a thermal acoustic material that is applied between adjacent glazing elements 60 positioned on the support plates 52, 52' of the steel support beams 50. While the thermal acoustic material is applied for the purpose of improving sound insulation performance of the curtain wall system, they are more commonly used to assist in reducing flanking transmission between adjacent internal areas i.e., 'room to room' and 'floor to floor' flanking sound transmission. Beneficially the thermal acoustic material when applied between adjacent glazing elements 60 conceals the underlying fastening mechanisms thereby providing an aesthetically appealing curtain wall system.

For the purpose of teaching the present invention, the curtain wall installation kit has been described to include the above said components. However, the same should not be read in a manner that would limit the scope of the present invention as the kit in few other embodiments of the present invention can include other conventional components that are traditionally used in curtain wall system such as screws, bolts or other fastening means, corner blocks etc.

Figure 7:
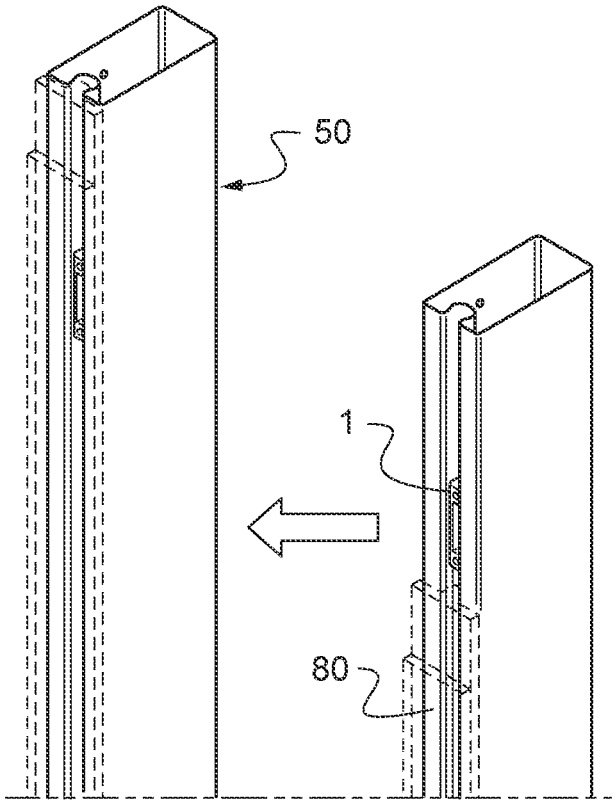
FIG. 7 shows the step of pressing a gasket over the steel support beams during a curtain wall installation, according to an embodiment of the present invention; and FIG. 8A
Figure 8A:
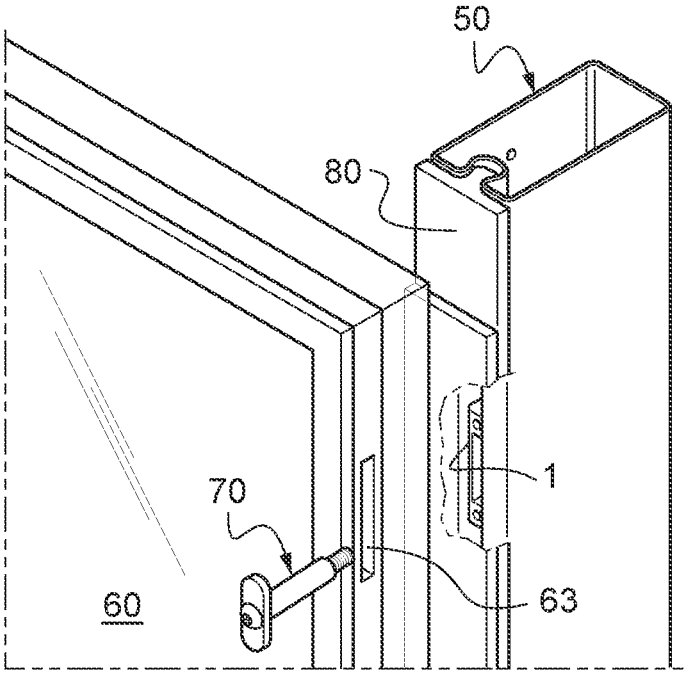
FIG. 8B illustrates steps of securing glazing elements on to the steel support beams using toggle assembly, according to an embodiment of the present invention.
Figure 8B:
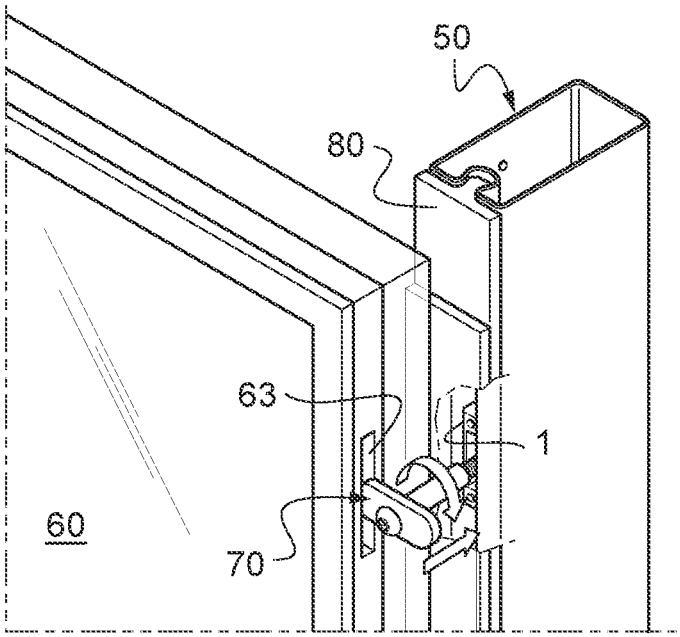

For all the above described embodiments, the method for assembling a curtain wall in a façade structure comprises the following steps: mounting steel support beams 50 on the outer surface of a building to form a curtain wall substructure; fixing toggle inserts 1 within the gasket race 51 of the steel support beams 50 in turn involving the steps of dropping the toggle insert 1 into the gasket race 51 of the steel support beams 50 such that the intermediate portion 15*b* of the toggle insert 1 abuts the neck of the gasket race 51; rotating the toggle insert 1 90 degrees for the front portion 15*a* to face away from neck of the gasket race 51 and screwing the pair of threaded set screws 20, 20' into the slotted screw race 17, 17', wherein the screwing tightens the set screws 20, 20' forcing the toggle insert 1 into the neck of the gasket race 51 and securing the toggle insert 1 to the steel support beams 50; pressing the gasket 80 into the neck of the gasket race 51 such that the gasket 80 is flush with the gasket race 51 and support plates 52, 52' of the steel support beams 50 (as shown in FIG. 7); securing the glazing elements 60 on the curtain wall substructure using toggle assemblies 70, wherein the elongated opening 16 in the horizontal section 15 of the toggle insert 1 provides a screw tolerance of 1 inch for securing the screw 73 of the toggle assembly 70; turning the toggle 71 of the toggle assembly 70 such that the toggle 71 is placed within the U-shaped channel insert 63 set in the glazing element 60 thereby anchoring the glazing element 60 to the steel support beams 50 (as shown in FIG. 8A and FIG. 8B) and applying the thermal acoustic material in the space between adjacent glazing elements 60 to conceal underlying fixing components.

INDUSTRIAL APPLICABILITY

Thus the use of toggle insert 1 of the present invention reduces time, skill and complexity associated with the conventional curtain wall systems and further provides a stable and flexible curtain wall installation procedure.

It will be appreciated that the invention has application to a wide variety of glazing structures in addition to the glazing element illustrated, for example triple glazed units, windows, panels, boards etc. Although the invention is described for installing a curtain wall system comprising a double glazed element, the application of the invention also extends to installing monolithic glazing in a curtain wall substructure. Likewise, although an exemplary design of the toggle insert is depicted in the figures of the present invention it should be understood that design modifications that would he made to the toggle insert in order for the toggle insert to be compatible and usable for the varied shaped of gasket race of steel support beams described earlier are well within the scope of the present invention.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

Note that not all of the activities described above in the general description or the examples are required, that a portion of a specific activity may not be required, and that one or more further activities may be performed in addition to those described. Still further, the order in which activities are listed is not necessarily the order in which they are performed.

Benefits, other benefits, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Certain features, that are for clarity, described herein in the context of separate embodiments, may also be provided in combination in a single embodiment. Conversely, various features that are, for brevity, described in the context of a single embodiment, may also be provided separately or in a sub combination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

The description in combination with the figures is provided to assist in understanding the teachings disclosed herein, is provided to assist in describing the teachings, and should not be interpreted as a limitation on the scope or applicability of the teachings. However, other teachings can certainly be used in this application.

As used herein, the terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent that certain details regarding specific materials and processing acts are not described, such details may include conventional approaches, which may be found in reference books and other sources within the manufacturing arts.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

LIST OF ELEMENTS

1 Toggle Insert
15 Horizontal Section
15*a* Front Portion
15*b* Intermediate Port
15*c* Bottom Portion
16 Central Elongated Opening
17, 17' Slotted Screw Race
20, 20' Threaded Set Screws
30 Beam Cavity
50 Steel Support Beam
51 Gasket Race
52 Support Plate
60 Glazing Element
61 Spacer Frame
62 interior Space
63 U-shaped channel inserts
70 Toggle Assembly
71 Toggle
72 Plastic Sleeve
73 Screw
80 Gasket
100 Curtain Wall System

The invention claimed is:

1. A toggle insert for receiving a toggle assembly in a steel curtain wall structure, the toggle insert comprising:

a horizontal section having a front portion, an intermediate portion and a bottom portion, wherein the front portion comprises a central elongated opening measuring between 21 mm and 25 mm in length and sandwiched on either sides by a slotted screw race; and a pair of threaded set screws for leveling into the slotted screw races that fixes the toggle insert by way of wedging into the steel curtain wall structure, wherein the intermediate portion of the horizontal section is oblong having an internal angle ranging between 34 and 38 degrees.

2. The toggle insert as claimed in claim 1, wherein the internal angle is 36 degrees.

3. The toggle insert as claimed in claim 1, wherein the toggle insert is a self-levelling profile requiring no welding for fastening to the steel curtain wall structure.

4. The toggle insert as claimed in claim 1, wherein the central elongated opening of the horizontal section provides a screw tolerance of up to 1 inch for locating and fastening screws during installation of glazing elements to the steel curtain wall structure.

5. The toggle insert 1 as claimed in claim 1, wherein the horizontal section is a steel bar profile.

6. A glass curtain wall installation kit comprising:

steel support beams for mounting on an outer surface of a building to form a curtain wall substructure;

glazing elements having at least two parallel glazing bonded to one another and spaced apart by a spacer frame, a space external to said spacer frame between the two glazing filled with a sealing material;

toggle assemblies having a toggle, a plastic sleeve and a screw for securing the glazing elements to the steel support beams;

toggle inserts comprising a horizontal section having a front portion, an intermediate portion and bottom portion, wherein the front portion comprises a central elongated opening measuring between 21 mm and 25 mm in length and sandwiched on either sides by a slotted screw race; and a pair of threaded set screws for leveling into the slotted screw races and fixing the toggle insert to the steel support beams, wherein the intermediate portion of the horizontal section is oblong having an internal angle ranging between 34 and 38 degrees and wherein the toggle inserts are fixed by way of wedging to the steel support beams for receiving the toggle assemblies;

a gasket for overlaying the curtain wall substructure; and a thermal acoustic material for application between adjacent glazing elements anchored to the steel support beams.

7. The glass curtain wall installation kit as claimed in claim 6, wherein the steel support beams comprise a box shaped cross-section having a gasket race extending longitudinally along their length, wherein the gasket race has a narrow opening and a wider inner surface flanked on either sides by support plates.

8. The glass curtain wall installation kit as claimed in claim 7, wherein the gasket race of the steel support beams is rectangular or circular or square in cross-section.

9. The glass curtain wall installation kit as claimed in claim 7, wherein a shape of the horizontal section of the toggle insert is adapted to a shape of the gasket race.

10. The glass curtain wall installation kit as claimed in claims 6, wherein the glazing elements further comprise U-shaped channel inserts set within the sealing material bonding the two glazings.

11. A method for assembling a curtain wall in a façade structure using the glass curtain wall installation kit according to claim 6, said method comprising:

mounting steel support beams on the outer surface of the building to form the curtain wall substructure;

securing toggle inserts within a gasket race of the steel support beams involving:

dropping the toggle insert into the gasket race of the steel support beams such that the intermediate portion of the toggle insert abuts a neck of the gasket race;

rotating the toggle insert 90 degrees for the front portion to face away from the neck of the gasket race; and screwing the pair of threaded set screws into the slotted screw race, wherein the screwing tightens the set screws forcing the toggle insert into the neck of the gasket race eliminating any welding action for securing the toggle insert to the steel support beams;

pressing the gasket into the neck of the gasket race such that the gasket is flush with the gasket race and support plates of the steel support beams;

securing the glazing elements on the curtain wall substructure using toggle assemblies, wherein the elongated opening in the horizontal section of the toggle insert provides a screw tolerance of 1 inch for securing the screw of the toggle assembly;

turning the toggle of the toggle assembly such that the toggle is placed within a U-shaped channel insert set in the glazing element thereby anchoring the glazing element to the steel support beams; and applying the thermal acoustic material in the space between adjacent glazing elements to conceal underlying fixing components.

* * * * *